US005702591A

United States Patent [19]

Okamoto et al.

[11] Patent Number: 5,702,591

[45] Date of Patent: Dec. 30, 1997

[54] FLOTATION METHOD FOR NON-FERROUS METAL VARIABLE ORES

[75] Inventors: Hideyuki Okamoto; Hiroichi Miyashita, both of Niihama; Ryoichi Nakayama, Saijo, all of Japan

[73] Assignee: Sumitomo Metal Mining Co., Ltd., Tokyo, Japan

[21] Appl. No.: 596,039

[22] Filed: Feb. 6, 1996

[30] Foreign Application Priority Data

Feb. 20, 1995 [JP] Japan ..... 7-030361

[51] Int. Cl.[6] ..... B03D 1/06; B03D 1/002

[52] U.S. Cl. ..... 209/167; 209/1

[58] Field of Search ..... 209/1, 166, 167, 209/901

[56] References Cited

U.S. PATENT DOCUMENTS

| | | |
|---|---|---|
| 1,678,259 | 7/1928 | Martin . |
| 4,283,017 | 8/1981 | Coale . |
| 4,460,459 | 7/1984 | Shaw . |
| 4,561,970 | 12/1985 | Heimala . |
| 4,879,022 | 11/1989 | Clark . |
| 5,074,994 | 12/1991 | Ray . |
| 5,110,455 | 5/1992 | Huch . |
| 5,411,148 | 5/1995 | Kelebek . |
| 5,439,115 | 8/1995 | Beyzavi . |

FOREIGN PATENT DOCUMENTS

| | | |
|---|---|---|
| 1243349 | 10/1988 | Canada . |

OTHER PUBLICATIONS

Forssberg, K. S. Eric; "Proceedings of the XVI International Mineral Processing Congress", Stockholm, Sweden, Jun. 10, 1988, pp. 565–578.

*Primary Examiner*—Thomas M. Lithgow

*Attorney, Agent, or Firm*—Watson Cole Stevens Davis, P.L.L.C.

[57] ABSTRACT

The present invention concerns a method of separating variable ores containing copper, lead, zinc and the like as the refining material for non-ferrous metals and gangue minerals such as pyrite, quartz, feld spar and the like from dug out ores and, particularly, it relates to a flotation method. For obtaining non-ferrous metal valuable ores as concentrates from ores by a flotation method, flotation is conducted by using gaseous sulfurous acid or aqueous sulfurous acid as a depressant for controlling the floatability of pyrite. The flotation method comprises measuring the redox potential of an ore solution before and after the addition of gaseous sulfurous acid or aqueous sulfurous acid and determining an optimum addition amount by utilizing a proportional relationship present between the difference of the potential and the valuable quality enhancing rate. According to the method, it is possible to judge the effect of depressing pyrite, that is, the effect of sulfurous acid for enhancing the valuable quality without complicate analysis or test and, further, when the method is applied to automatic control, an utmost economical merit can be obtained by quality control of concentrates or saving of wasteful consumption of the reagent.

4 Claims, No Drawings

FLOTATION METHOD FOR NON-FERROUS METAL VARIABLE ORES

BACKGROUND OF THE INVENTION

1. Field of the Invention

The present invention concerns a method of separating valuable ores containing copper, lead, zinc and the like as the refining material for non-ferrous metals and gangue minerals such as pyrite, quartz, feld spar and the like from dug out ores and, particularly, it relates to a flotation method.

2. Description of the Prior Arts

Flotation has been adopted generally as a method of separating to recover variable metal ores such as copper, lead and zinc from ores and obtaining concentrates as the raw material for refining non-ferrous metals. The flotation generally comprises a roughening step of separating gangue minerals such as quartz and feld spar which occupy a most portion of the raw ores and sulfide minerals containing valuable metals, and a cleaning step of converting variable metal sulfide ores into compositions capable of being used as the raw materials for refining.

Raw material ores of non-ferrous metals generally contain pyrite of low value and, if they are incorporated by a great amount in concentrates, the quality of value in the concentrates is lowered to remarkably lower the value as the refining raw material. Since the pyrite tends to behave like valuable floating minerals, such as copper sulfides, it is customary to add an appropriate reagent in the cleaning step to lower the floatability of the pyrite. The reagent is referred to as a depressant, and gaseous sulfurous acid or an aqueous solution thereof is used, being considered inexpensive and effective.

Since there has been no method for occasionally judging the effect of sulfurous acid for depressing pyrite during operation, a preliminary test was conducted and the addition amount of sulfurous acid in the actual operation was determined based on the result of the test. However, in such a method, if the ingredients or natures of ores to be processed are changed, the optimum addition amount has to be determined on every case by carrying out the test, which makes the operation troublesome. Further, even in accordance with such a method, since the composition of the ores inevitably fluctuate during operation, such fluctuation during operation is generally neglected or ignored and a predetermined amount of the reagent is always added. Thus, depending on the case, the addition amount becomes excessive to wastefully consume the reagent or depress even variable ores as well, or the addition amount tends to lack making the depression of pyrite insufficient to bring about a problem of lowering the quality of aimed elements in the concentrates.

SUMMARY OF THE INVENTION

An object of the present invention is to overcome the foregoing problems in the prior art method and provide a flotation method for non-ferrous metal variable ores capable of judging a required amount of gaseous or aqueous sulfurous acid by a simple and convenient method, thereby capable of stabilizing the operation.

In view of the foregoing problems, the present inventors have made a study on a relationship between the addition amount of sulfurous acid and physicochemical properties of ore solutions, and the result of a dressing test conducted for the ore solutions regarding various non-ferrous metal ores, and as a result have found a method capable of determining an optimum addition amount of gaseous or aqueous sulfurous acid without complicated tests and have accomplished the present invention.

That is, in accordance with the present invention, a redox potential of an ore solution is measured before and after the addition of a gaseous or aqueous sulfurous acid and the optimum addition amount is determined by utilizing a proportional relationship which is present between the difference of the potential and the enhancing rate of variable quality. More specifically, a desired ORP variation amount is determined in accordance with following equation 1 or 2, and a depressant of gaseous or aqueous sulfurous acid is added such that the variation amount of the redox potential (ORP) of the ore solution corresponds to the variation amount thereof.

$$\text{Metal quality enhancing extent} = -0.114 \times \text{ORP variation amount} + 0.082 \quad (1)$$

$$\text{Metal quality enhancing extent} = -0.114 \times \text{ORP variation amount} \quad (2)$$

DETAILED DESCRIPTION OF THE INVENTION

The present inventors, have carried out flotation tests for various kinds of ores and investigated the addition amount of sulfurous acid, the redox potential and behaviors of minerals contained in the ores. As a result, it has been found that the extent that the floatability of the ores is suppressed differs depending on the ores even if the difference between the initial value of the redox potential and the redox potential after addition of sulfurous acid is constant, that is, the variation amount of the redox potential (ORP) is constant. It has also been found for the pyrite that the variation amount of the floatability of the pyrite per variation amount of the redox potential is large, that is, the depression effect is large, as well as that the depression effect is in proportion with the variation amount of the redox potential.

According to this relationship, the enhancing extent of the concentrate quality can be forecast only by way of the difference of the redox potential with no analysis for final products and the addition amount of sulfurous acid to reach the aimed quality can be calculated rapidly. Furthermore, the optimum addition amount of the suppressor can be calculated easily by considering the increase of profits due to quality enhancement and the increase of the expenditures caused by the addition cost of sulfurous acid and decreasing ratio of actual yield of variables. It has yet not been apparent at present for the mechanism when pyrite is depressed by the addition of gaseous or aqueous sulfuric acid and direct operating factors have yet been specified.

The present invention will be explained by way of the following examples.

EXAMPLE 1

Customary flotation was conducted for five kinds of copper ores yielded from mines in U.S.A. to obtain five kinds of rougher flotation concentrate at copper quality from 3.78 to 5.06% by weight.

Then, sulfurous acid was added as an aqueous sulfurous acid in an amount each of 0, 500, 1,000 and 2,500 g/t based on the amount of solids in the ore solution into ore solutions in which each of flotation minerals are suspended. In this case, the pH value of the ore solution before and after the addition of aqueous sulfurous acid was maintained at 11 by using slaked slime.

Subsequently, concentrating flotation was conducted for the ore solutions each for 13 minutes to obtain final copper concentrates.

Each of the copper concentrates was analyzed to determine the quality of the copper concentrates. The results are shown in Table 1.

TABLE 1

| Kind of ores | Rougher concentrate grade (%) Cu | pyrite | Addition amount g/t | ORP variation mV | Concentrate Cu grade wt % | Cu grade enhancement wt % |
|---|---|---|---|---|---|---|
| A | 5.06 | 29.1 | 0 | 0 | 22.40 | 0.00 |
| | | | 500 | −18 | 26.22 | 3.82 |
| | | | 1000 | −30 | 26.97 | 4.57 |
| | | | 2500 | −39 | 26.77 | 4.37 |
| B | 4.83 | 21.0 | 0 | 0 | 26.66 | 0.00 |
| | | | 500 | −14 | 28.92 | 2.26 |
| | | | 1000 | −21 | 30.57 | 3.91 |
| | | | 2500 | −38 | 30.91 | 4.25 |
| C | 3.78 | 24.2 | 0 | 0 | 22.17 | 0.00 |
| | | | 500 | −13 | 23.62 | 1.45 |
| | | | 1000 | −28 | 24.68 | 2.51 |
| | | | 2500 | −36 | 26.16 | 3.99 |
| D | 4.60 | 22.4 | 0 | 0 | 25.81 | 0.00 |
| | | | 500 | −7 | 26.84 | 1.03 |
| | | | 1000 | −14 | 28.16 | 2.35 |
| | | | 2500 | −27 | 28.86 | 3.05 |
| E | 4.79 | 17.4 | 0 | 0 | 25.30 | 0.00 |
| | | | 500 | −8 | 26.99 | 1.69 |
| | | | 1000 | −13 | 26.71 | 1.41 |
| | | | 2500 | −19 | 27.35 | 2.05 |

In Table 1, the addition amount of sulfurous acid represents the addition amount of pure S02 based on the weight of the solids in the rougher flotation. Further, variation of the redox potential (ORP) is determined by measuring the redox potential of the ore solution before and after the addition of sulfurous acid by using a silver-silver chloride electrode, and subtracting the potential after addition from the potential before addition.

As apparent from Table 1, there is twice or greater difference in the enhancing extent for the copper concentrate quality even with the identical addition amount of sulfurous acid. Accordingly, twice or greater difference is caused by the existent method of setting the addition amount constant. However, in view of the relationship between the ORP and the quality enhancing extent, it can be seen that the numerical value obtained by dividing the absolute value of ORP variation with 9 is approximately equal with the quality enhancing extent. While various approximate equations may be considered for the method of calculating the quality enhancing extent in view of the ORP variation, a method of merely multiplying a constant coefficient is simple and convenient, which can provide a practically sufficient accuracy.

When the relation between the ORP variation amount and the copper grade enhancing extent is analyzed according to a method of least squares based on the numerical values shown in Table 1, a relationship represented by the equation 3 can be obtained.

$$\text{Copper grade enhancing extent} = -0.114 \times \text{ORP variation amount} + 0.282 \quad (3)$$

In the equation 2 described previously, 0.282 in the light term of the equation 3 is ignored being considered negligibly small. In the equation 2, enhancing extent of the copper quality can be forecast by multiplying −0.114 to the measured variation amount of ORP.

Table 2 shows the measured ORP variation amount, the calculated value for enhancing extent of the copper grade determined by multiplying −0.114, the actually measured value shown in Table 1 and the difference therebetween.

TABLE 2

| Kind of ores | ORP variation (mV) | Copper grade amount Calculated | enhancement (wt %) Measured | Difference (wt %) |
|---|---|---|---|---|
| A | 0 | 0.00 | 0.00 | 0.00 |
| | −18 | 2.05 | 3.82 | −1.77 |
| | −30 | 3.42 | 4.57 | −1.15 |
| | −39 | 4.45 | 4.37 | 0.08 |
| B | 0 | 0.00 | 0.00 | 0.00 |
| | −14 | 1.60 | 2.26 | −0.66 |
| | −21 | 2.39 | 3.91 | −1.52 |
| | −38 | 4.33 | 4.25 | 0.08 |
| C | 0 | 0.00 | 0.00 | 0.00 |
| | −13 | 1.48 | 1.45 | 0.03 |
| | −28 | 3.19 | 2.51 | 0.68 |
| | −36 | 4.10 | 3.99 | 0.11 |
| D | 0 | 0.00 | 0.00 | 0.00 |
| | −7 | 0.80 | 1.03 | −0.23 |
| | −14 | 1.60 | 2.35 | −0.75 |
| | −27 | 3.08 | 3.05 | 0.03 |
| E | 0 | 0.00 | 0.00 | 0.00 |
| | −8 | 0.91 | 1.69 | −0.78 |
| | −13 | 1.48 | 1.41 | 0.07 |
| | −19 | 2.17 | 2.05 | 0.12 |

The each of errors in Table 2 is a difference between the actual copper quality enhancing extent obtained from the result of analysis and the calculated value.

As apparent from Table 2, the quality enhancing extent can be forecast at a high accuracy by using an identical coefficient for all kinds of ores. Accordingly, the required addition amount of aqueous sulfurous acid can be determined with no complicate flotation test or analysis.

Various methods can be applied, as required, to the automatic control method based on the forecast value. For example, by making the ORP variation constant, it is always possible to keep the copper quality enhancing extent constant thereby avoiding excess addition of the reagent. In addition, the optimum addition amount for each kinds of ores can be calculated rapidly offsetting the increase of profits caused by copper quality enhancement and the addition cost of aqueous sulfurous acid required therefor.

EXAMPLE 2

Using the ore B used in Example 1, a test was conducted for obtaining concentrates at a copper grade of 30.00%.

Specifically, aqueous sulfurous acid was added such that the variation amount of the redox potential (orp) was −29.4 mV according to: −(30.00−26.66)/0.114=−29.4. The addition amount of aqueous sulfurous acid was 1740 g/t. In this case, the pH value of the ore solution was maintained at 11 before and after the addition of aqueous sulfurous acid by using slaked slime.

Subsequently, concentrating flotation was conducted for the ore solutions each for 13 min to obtain copper concentrates.

The copper quality of the resultant copper concentrates was 29.8 % by weight, which was substantially equal with the calculated value.

As has been described above by the method according to the present invention, it is possible to judge the effect of suppressing pyrite, that is, the effect of sulfurous acid to the valuable quality enhancing extent without complicated analysis or tests. Further, when the method is applied to the automatic control, utmost economical advantage can be obtained by quality control for concentrates or saving of wasteful consumption of the reagent.

We claim:

1. A method for the froth flotation of a non-ferrous metal valuable ore which contains said non-ferrous metal valuable ore and pyrite, said method comprising adding gaseous sulfurous acid or aqueous sulfurous acid as a depressant for controlling the floatability of pyrite upon obtaining non-ferrous metal valuable ores as concentrates from ores to a solution of said ore to form a mixture, subjecting said mixture to froth flotation, measuring a redox potential of said ore solution before and after addition of said gaseous sulfurous acid or aqueous sulfurous acid, and determining an optimum addition amount for a desired valuable metal quality enhancing extent of the concentrate by utilizing a proportional relationship which is present between the difference of the potential and the valuable quality enhancing extent of the concentrate.

2. A flotation method for non-ferrous metal valuable ores as defined in claim 1, wherein a desired variation amount of redox potential (ORP) is determined in accordance with the following equation 4 and the depressant is added such that the variation amount of ORP of the ore solution corresponds to the variation amount thereof:

$$\text{Metal grade enhancing extent} = -0.114 \times \text{ORP variation amount} \quad (4).$$

3. A flotation method for non-ferrous metal valuable ores as defined in claim 1, wherein a desired variation amount of redox potential (ORP) is determined in accordance with the following equation 5 and the depressant is added such that the variation amount of ORP of the ore solution corresponds to the variation amount thereof:

$$\text{Metal grade enhancing extent} = -0.114 \times \text{ORP variation amount} + 0.282 \quad (5).$$

4. A flotation method for non-ferrous metal valuable ores as defined in claim 1, wherein the non-ferrous metal valuable ores are copper-containing ores.

* * * * *